US005686788A

United States Patent [19]

Lauter

[11] Patent Number: 5,686,788

[45] Date of Patent: Nov. 11, 1997

[54] LOW-PRESSURE DISCHARGE LAMP WITH STARTING AMALGAM

[75] Inventor: Friedrich Lauter, Augsburg, Germany

[73] Assignee: Patent-Treuhand-Gesellschaft für elektrische Glühlampen mbH, Munich, Germany

[21] Appl. No.: 547,737

[22] Filed: Oct. 26, 1995

[30] Foreign Application Priority Data

Dec. 20, 1994 [DE] Germany ..... 44 45 532.1

[51] Int. Cl.[6] ..... H01J 61/24; H01J 61/54

[52] U.S. Cl. ..... 313/490; 313/550; 313/551; 445/23; 445/29

[58] Field of Search ..... 313/490, 547, 313/550, 551; 445/23, 29

[56] References Cited

U.S. PATENT DOCUMENTS

| | | | |
|---|---|---|---|
| 3,713,201 | 1/1973 | Evans . | |
| 3,860,852 | 1/1975 | Latassa et al. . | |
| 4,047,071 | 9/1977 | Busch et al. | 313/490 |
| 4,105,910 | 8/1978 | Evans | 313/490 |
| 4,288,715 | 9/1981 | van Overveld et al. | 313/490 |
| 4,539,508 | 9/1985 | Mulder et al. . | |
| 5,274,305 | 12/1993 | Bouchard . | |
| 5,412,288 | 5/1995 | Borowiec et al. | 313/490 |

FOREIGN PATENT DOCUMENTS

| | | |
|---|---|---|
| 0 479 259 | 4/1992 | European Pat. Off. . |
| 2 115 662 | 7/1972 | France . |
| 2 438 912 | 5/1980 | France . |
| 26 16 577 | 11/1976 | Germany . |
| WO 93/11557 | 6/1993 | WIPO . |

OTHER PUBLICATIONS

Patent Abatracts of Japan, vol. 009, No. 295 (E–360), of JP 60–133649, Toshiba K.K., Jul. 16, 1985.

"Technisch–wissenschaftliche Abhandlungen der Osram–Gesellschaft" (Technological–Scientific Publication of the Osram Company), published by Springer Publishers, Berlin Heidelberg New York, 1973, Article by Hofmann and Rasch, The Mercury Vapor Pressure of Indium–Amalgam and the Light Flux–Temperature Curve of New Indium–Amalgam Fluorescent Lamps, pp. 106–119.

"Proceedings of the IEE", vol. 127, Part A, No. 3, Apr. 1980, p. 152.

*Primary Examiner*—Nimeshkumar Patel

*Attorney, Agent, or Firm*—Frishauf, Holtz, Goodman, Langer & Chick, P.C.

[57] ABSTRACT

To retain a starting amalgam in a fluorescent lamp, a carrier body (7, 7', 37, 47), for example formed as an iron sheet-metal element of about 2.5×7 mm, and having a thickness of, for example, 0.2 mm, is secured to a glass element (6, 6', 36, 46) which retains current supply leads (3, 4, 3', 4') extending into the discharge vessel of the lamp, and holding the filament (5, 5') therein. The carrier body can also be a mesh or a wire; it may be melted into, or glazed-on or melted-on the glass element. This permits locating the starting amalgam close to the hottest portion of the electrode mount for the lamp for rapid supply of mercury upon firing of the lamp.

14 Claims, 2 Drawing Sheets

LOW-PRESSURE DISCHARGE LAMP WITH STARTING AMALGAM

Reference to related patent, the disclosure of which is hereby incorporated by reference:

U.S. Pat. No. 5,274,305, Bouchard.

Reference to related literature:

"Technisch-wissenschaftliche Abhandlungen der Osram-Gesellschaft" ("Technological-Scientific Publication of the Osram Company"), published by Springer Publishers, Berlin Heidelberg New York, 1973, Article by Hofmann and Rasch, "The Mercury Vapor Pressure of Indium-Amalgam and the Light Flux-Temperature Curve of New Indium-Amalgam Fluorescent Lamps", pages 106–119;

"Proceedings of the IEE", Volume 127, Part A, No. 3, Apr. 1980, page 152.

FIELD OF THE INVENTION

The present invention relates to low-pressure discharge lamps, and more particularly to fluorescent lamps, in which mercury is included in the discharge vessel as part of an ionizing fill. The mercury in lamps of this type is provided in the discharge vessel in form of an amalgam.

BACKGROUND

Customarily, fluorescent lamps may have two or more amalgam elements therein, one being an operating amalgam, and one other, or others, being one or more starting amalgams. The operating amalgam usually is positioned in a location within the discharge vessel which, in operation, is subjected to only slightly varying temperature, typically between about 90° C. and 100° C. The starting amalgam, or amalgams, are positioned in locations which are hotter than the location of the operating amalgam and ensure rapid run-on of the low-pressure discharge lamp after firing or starting. Thus, the lamp is supplied, as rapidly as possible and shortly after ignition, with mercury vapor for the discharge even before the operating amalgam has reached its optimal temperature.

Low-pressure discharge lamps, and typically fluorescent lamps, are described in the article "The Mercury Vapor Pressure of Indium-Amalgam and the Light Flux-Temperature Curve of New Indium-Amalgam Fluorescent Lamps" by Hofmann and Rasch, printed on pages 106–119 in Volume 11 of the "Technisch-wissenschaftliche Abhandlungen der Osram-Gesellschaft" ("Technological-Scientific Publication of the Osram Company"), published by Springer Publishers, Berlin Heidelberg New York, 1973; pages 117 to 118 are of specific interest. The lamp described in this publication has an operating, or main, amalgam which is applied on the foot or root portion of a flare mount of the lamp filament. Two further starting, or auxiliary, amalgams are provided. A first starting amalgam is placed on one of the electrode caps, in immediate vicinity of the electrode filament; a second starting amalgam is located in the region of the flare mount pinch seal, in which current supply leads for the filament supports are pinch or press-sealed. FIG. 7 on page 117 of this publication illustrates this arrangement.

U.S. Pat. No. 5,274,305, Bouchard, describes a low-pressure mercury discharge lamp which has a thermostatic control for vapor pressure. The filament supply is not formed by a flare melt-sealed mount, as described in the aforementioned publication, but rather is formed, primarily, by a glass rod which stabilizes the electrode filaments and the current supplies before and during the pinch sealing of the discharge vessel. The lamp, as described, has a small ampule, or capsule, which is filled with starting amalgam. It is held in the vicinity of the filament by one of the current supply leads. The current supply lead is wrapped a few times about the capsule, in the form of a heater winding. This type of electrode mount, as well as sealing of the discharge vessel about the current supply leads, is utilized primarily in compact fluorescent lamps; flare mounts are used usually in straight tubular lamps, for example of the T8, T10, T12 type fluorescent lamps.

THE INVENTION

It is an object to provide a low-pressure mercury vapor discharge lamp, typically a fluorescent lamp, in which the support for the starting amalgam is improved, and in which the support can be used in lamps with flare mounts as well as lamps having electrode assemblies in which the current supply leads for the filament are stabilized by a glass bead, or by a glass rod, and in which the discharge vessel itself is pinch-sealed over the current supply leads.

Briefly, the starting amalgam is applied on an elongated metal element, forming a carrier body or amalgam support such as a coated, small metal plate, and the carrier body is melted-in or melted-on a glass element of the filament support; this glass element can be either a bead, or glass rod to stabilize the current supply leads or may be a portion of a pinched-flare mount.

The carrier body or support for the starting amalgam is directly melted-in, or melted-on a glass body, or glass element which is part of the electrode or filament mount. This is done by either plunging, sticking, or stabbing the amalgam support into the glass element or glass body for a limited distance and while it is still soft; alternatively, it can be applied on the glass body, to be melted thereon, or thereagainst, by being glazed on the glass body while it is still soft and deformable. After the glass has cooled, the amalgam support is reliably and simply retained and secured on the glass element. The indium-amalgam support can thus be placed on any type of electrode mount, be it a flare mount, or a glass bead or glass rod stabilizing the electrode subassembly.

A suitable support for the amalgam is a small sheet-metal plate or strip, or a metallic mesh which is coated with a substance forming the amalgam. A metal wire, coated with an amalgam forming substance can also be used. The amalgam support body can be so located in the lamp that it is adjacent the hottest point of the electrode filament support, thereby eliminating creeping of the amalgam-forming substance in the direction towards the filaments.

DRAWINGS

Figure 1:
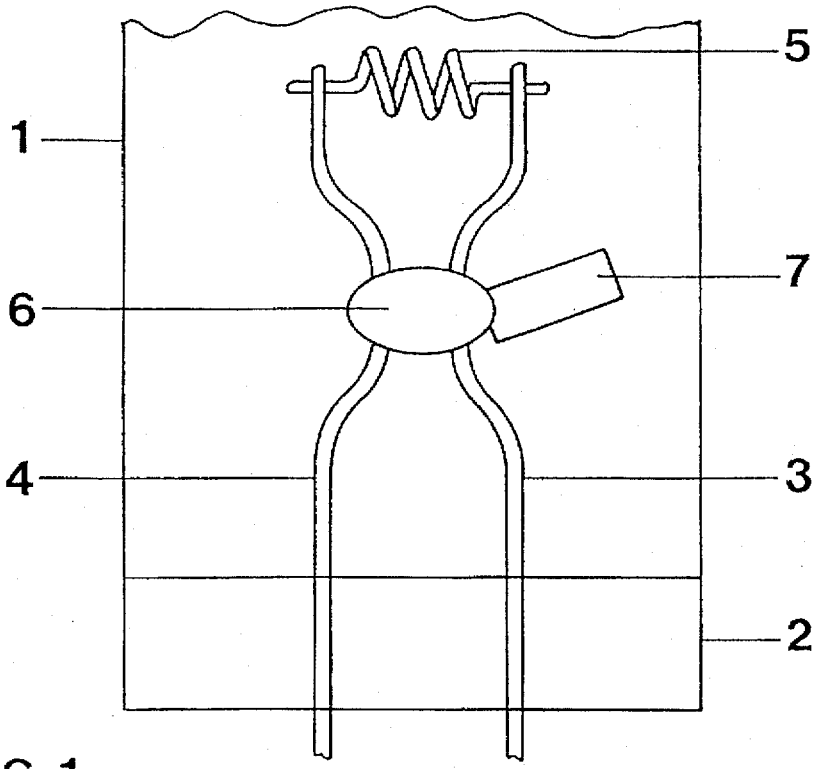
FIG. 1 is a highly schematic fragmentary side view of the end portion of a discharge vessel of a fluorescent lamp, in which electrode support wires are retained in a pinch seal.
Figure 2:
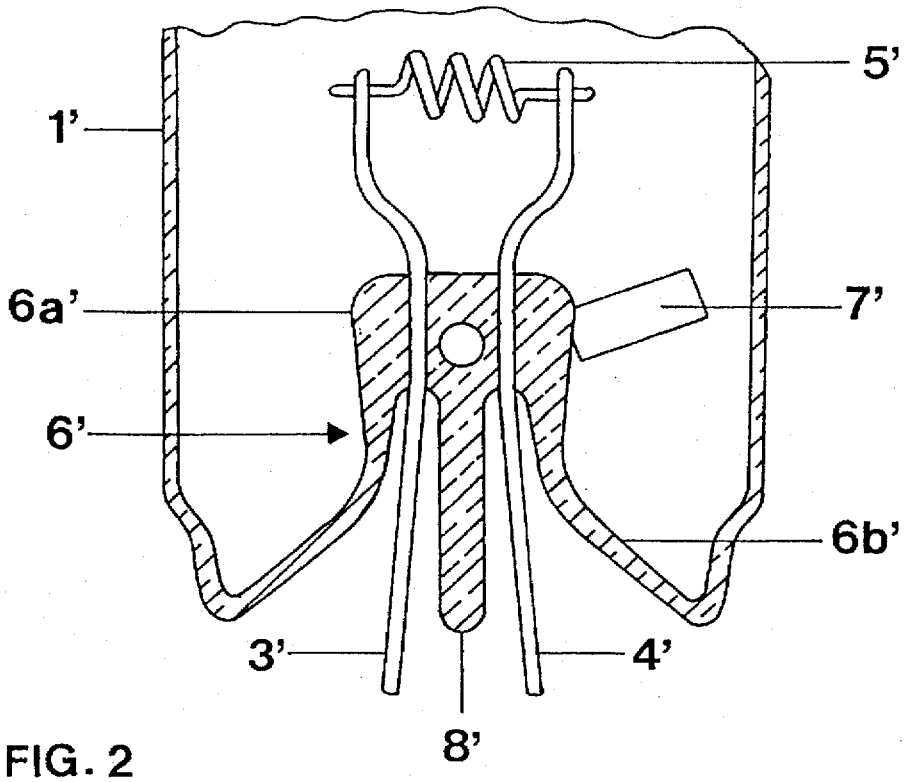
FIG. 2 is a schematic side view, partly in section, of the end portion of a discharge vessel of a low-pressure discharge lamp, in which the electrode support wires are retained in a flare mount.

In FIGS. 1 and 2, bases for the lamps have been omitted for clarity.

DETAILED DESCRIPTION

FIG. 1 illustrates the end portion of a compact fluorescent lamp in highly schematic form. The lamp has a tubular discharge vessel 1 made of glass which is closed at least at one end by a pinch seal 2. Two current supply leads 3, 4 extend through the pinch seal 2 to support an electrode filament 5 located within the discharge vessel. The current supply leads 3, 4 are welded to respective ends of the filament 5. Together with the filament 5 and the glass bead 6, the current supply leads 3, 4, melt-sealed in the glass of the discharge vessel 1 at the pinch seal 2, form an electrode mount for the fluorescent lamp. The glass bead 6 locates the current supply leads 3, 4 to which the filament 5 is connected, during the manufacture of the pinch seal 2.

In accordance with a feature of the present invention, a support 7 formed as a sheet-metal element, for example made of iron, is melted into the glass bead 6. This is done by plunging, sticking or stabbing the iron sheet-metal element 7 into the bead 6 for a depth of about 0.3 mm while the glass of the bead 6 is soft. The position in which the sheet-metal element 7 is plunged into the glass 6 is so selected that it is placed at the hottest point of the electrode mount. This prevents creeping of indium applied to the sheet-metal element 7 in the direction of the electrode filament 5. After the glass bead 6 has cooled, it is still possible to bend the element 7 mechanically. The surface of the sheet metal element 7 is about 2.5×7 mm; the iron sheet metal has a thickness of about 0.2 mm. The mercury introduced into the discharge lamp as a component of the fill therein, together with the indium on the metal support 7, forms an indium-amalgam when the lamp is first used, or inductively preheated. The indium-amalgam on the support 7 accelerates the run-on or starting of the lamp and forms an auxiliary, or starting, amalgam.

FIG. 2 illustrates the end portion of a low-pressure discharge lamp in which the tubular discharge vessel 1', made of glass, is gas-tightly melt-sealed by a flare mount 6'. Two current supply leads 3',4' extend through the flare mount, which are electrically conductively connected to a coiled electrode filament 5'. The melted-on flare mount 6' is formed by a glass tube, also called a dished or flare tube, through which the current supply leads 3',4' as well as an exhaust tube 8' extend. The upper end 6*a*' of the flare tube 6' is pinch-sealed around the current supply leads 3', 4' and the exhaust tube 8'; the lower end 6*b*' is flared outwardly to form a dish, which can be melt-sealed to the discharge vessel 1' itself. The pinch seal 6*a*' of the flare tube 6', together with the current supply lead 3',4' and the electrode filament 5', forms an electrode mount for the low-pressure discharge lamp.

In accordance with a feature of the invention, a sheet-metal element 7' is melted into the glass flare mount element 6'. The element 7' is coated with indium. The element 7' is plunged or stabbed or similarly inserted into the still soft glass of the flare mount portion 6*a*', for a depth of about 0.3 mm. The sheet-metal element has dimensions of about 2.5×7 mm, and a thickness of about 0.2 mm. The mercury introduced into the fIorescent lamp as portion of the fill, together with the indium on the metal support 7', forms an indium-amalgam, which accelerates starting of the lamp.

Figure 3:
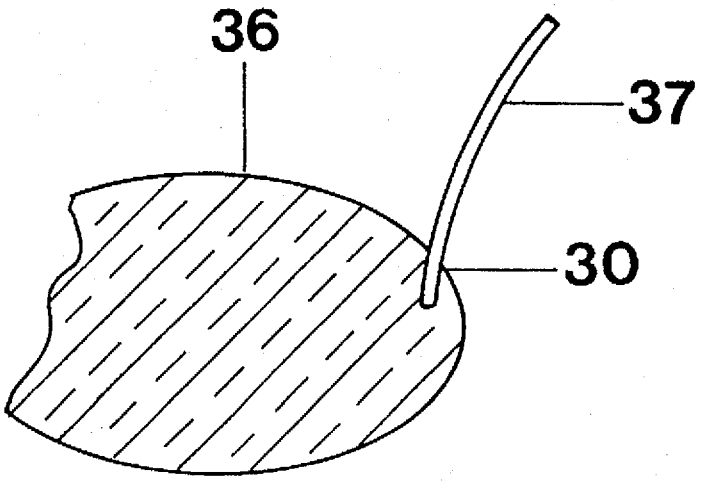
FIG. 3 is a fragmentary side view of a glass element retaining one of the electrode leads and illustrating the support for the starting amalgam melted-on the glass element.

FIG. 3 illustrates the application of a metal carrier element in form of a wire 37 on a glass element 36, melted-on to the surface thereof, for example by engaging a terminal part of the element 37 against a soft and deformable surface region 30 of the glass element 36 to form a glazed-on connection.

Figure 4:
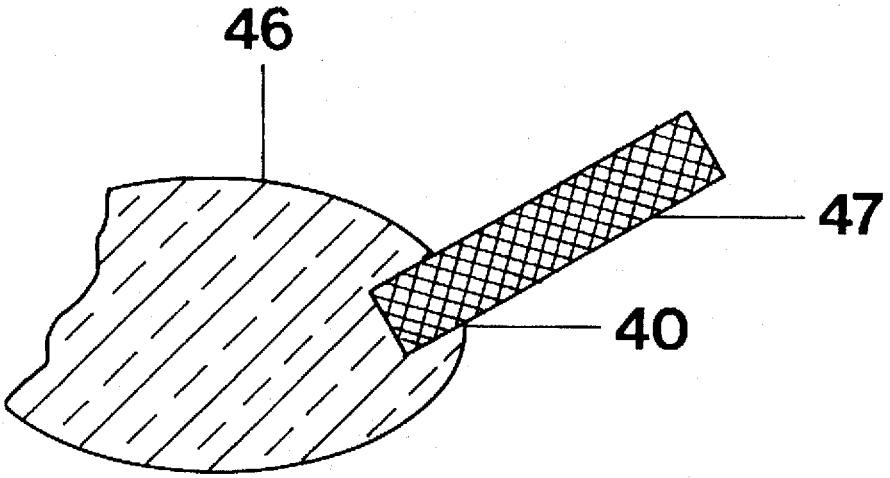
FIG. 4 is a view similar to FIG. 3 illustrating the support for the amalgam inserted into the glass element.

FIG. 4 illustrates a grid or mesh 47, e.g. similar in size to support 7, forming a carrier or support for the amalgam, inserted at region 40 into the glass element 46. The glass elements 36, 46 are shown only in fragmentary representation; they are part of the electrode mount, and may, when extended, have the shape of either the bead 6 (FIG. 1) or the portion 6*a*' of FIG. 2.

The carrier for the amalgam need not be a continuous sheet-metal element made of iron; other sheet-metal elements of high temperature resistant metals may be used. Carriers other than continuous sheet-metal elements, such as metal wires, metal grids, meshes or screens, can be used. Any support or carrier can be either melted into the glass element 6, 6', 6*a*', or melted-on. The dimension and shape of the carrier body is determined by and limited only by the diameter of the discharge vessel.

Besides indium, other metals which form amalgam can be used, for example cadmium. The size of the carrier element 7, 7', as well as the thickness of the layer forming the amalgam on the carrier, and hence the quantity of amalgam-forming material on the carrier, depends on the type and size of the lamp and can be easily determined using well-known engineering practice.

Various changes and modifications may be made, and any features shown or described herein may be used with any of the others, within the scope of the inventive concept.

I claim:

1. Low-pressure discharge lamp having a gas-tightly sealed discharge vessel (1, 1');

at least one electrode structure being melt-sealed to the discharge vessel, said at least one electrode structure including:

two current supply leads (3, 4; 3', 4');

a filament (5, 5') having terminal ends, mechanically and electrically connected to said current supply leads; and a glass element (6, 6', 36, 46), in which glass element the current supply leads are melt-sealed or pinch-sealed, an ionizing fill including mercury within said discharge vessel (1, 1'), and a starting amalgam which includes a carrier body (7, 7', 37, 47) on which a starting amalgam-forming substance is deposited, wherein in accordance with the invention, said carrier body comprises an elongated metal element (7, 7', 37, 47) which is inserted in and melted into said glass element (6, 6', 36, 46) through a minor portion of its length.

2. The lamp of claim 1, wherein said glass element (6, 6', 36, 46) comprises a glass bead (6), or glass rod, in which the current supply leads (3, 4) are melted-in.

3. The lamp of claim 1, wherein said glass element comprises a flare mount (6') gas-tightly melt-connected to an end portion of said discharge vessel (1').

4. The lamp of claim 1, wherein said elongated metal element is a sheet-metal element (7, 7') coated with said starting amalgam-forming substance.

5. The lamp of claim 1, wherein said elongated metal element comprises a metal mesh or screen element (47) coated with said starting amalgam-forming substance.

6. The lamp of claim 1, wherein said elongated metal element comprises a metal wire (37) coated with said starting amalgam-forming substance.

7. A method of providing starting amalgam in a discharge vessel (1, 1') of a low-pressure discharge lamp, as claimed in claim 1, wherein said lamp has a gas-tightly sealed discharge vessel (1, 1');

at least one electrode structure being melt-sealed to the discharge vessel, said at least one electrode structure including:

two current supply leads (3, 4; 3', 4');

a filament (5, 5') having terminal ends, mechanically and electrically connected to said current supply leads; and a glass element (6, 6', 36, 46), in which glass element the current supply leads are melt-sealed or pinch-sealed, an ionizing fill including mercury within said discharge vessel (1, 1'), and a starting amalgam, comprising the steps of providing an elongated metal element forming a carrier body (7, 7', 37, 47) coated with a starting amalgam-forming substance;

heating said glass element (6, 6', 36, 46) to deformation or softening temperature;

plunging, sticking or stabbing said elongated metal element, for a limited distance, into the heated glass element to thereby insert a small portion of the elongated metal element into the glass element; and permitting the glass element to cool, thereby retaining the carrier body thereon.

8. Low-pressure discharge lamp having a gas-tightly sealed discharge vessel (1, 1');

at least one electrode structure being melt-sealed to the discharge vessel, said at least one electrode structure including:

two current supply leads (3, 4; 3', 4');

a filament (5, 5') having terminal ends, mechanically and electrically connected to said current supply leads; and a glass element (6, 6', 36, 46), in which glass element the current supply leads are melt-sealed or pinch-sealed, an ionizing fill including mercury within said discharge vessel (1, 1'), and a starting amalgam which includes a carrier body (7, 7', 37, 47) on which a starting amalgam-forming substance is deposited, wherein in accordance with the invention, said carrier body (37, 47) comprises an elongated metal element which is melted-on or glazed-on said glass element (36, 46) over a minor portion of its length.

9. The lamp of claim 8 wherein said elongated metal element comprises a metal wire (37) coated with said starting amalgam-forming substance.

10. A method of providing starting amalgam in a discharge vessel (1, 1') of a low-pressure discharge lamp, as claimed in claim 8, wherein said lamp has a gas-tightly sealed discharge vessel (1, 1');

at least one electrode structure being melt-sealed to the discharge vessel, said at least one electrode structure including:

two current supply leads (3, 4; 3', 4');

a filament (5, 5') having terminal ends, mechanically and electrically connected to said current supply leads; and a glass element (6, 6', 36, 46), in which glass element the current supply leads are melt-sealed or pinch-sealed, an ionizing fill including mercury within said discharge vessel (1, 1'), and a starting amalgam, comprising the steps of providing an elongated metal element forming a carrier body (37, 47) coated with a starting amalgam-forming substance; and heating said glass element (36, 46) to deformation or softening temperature;

glazing-on or melting-on a limited longitudinal portion of said elongated metal element onto said heated glass element; and permitting the glass element to cool, thereby retaining the carrier body thereon.

11. The lamp of claim 8, wherein said elongated metal element comprises a metal mesh or screen element (47) coated with said starting amalgam-forming substance.

12. The lamp of claim 8, wherein said glass element (6, 6', 36, 46) comprises a glass bead (6), or glass rod, in which the current supply leads (3, 4) are melted-in.

13. The lamp of claim 8, wherein said glass element comprises a flare mount (6') gas-tightly melt-connected to an end portion of said discharge vessel (1').

14. The lamp of claim 8, wherein said elongated metal element is a sheet-metal element (7, 7') coated with said starting amalgam-forming substance.

* * * * *